US005720244A

United States Patent [19]

Faria

[11] Patent Number: 5,720,244

[45] Date of Patent: Feb. 24, 1998

[54] SWITCHABLE SUPPORT ELEMENT

[75] Inventor: Christof Faria, Röttenbach, Germany

[73] Assignee: Ina Wälzlager Schaeffler KG, Herzogenaurauch, Germany

[21] Appl. No.: 809,289

[22] PCT Filed: Aug. 21, 1995

[86] PCT No.: PCT/EP95/03318

§ 371 Date: Mar. 5, 1997

§ 102(e) Date: Mar. 5, 1997

[87] PCT Pub. No.: WO96/21801

PCT Pub. Date: Jul. 18, 1996

[30] Foreign Application Priority Data

Jan. 11, 1995 [DE] Germany ..... 195 00 575.9

[51] Int. Cl.[6] ..... F01L 13/00

[52] U.S. Cl. ..... 123/90.16; 123/90.41; 123/198 F

[58] Field of Search ..... 123/90.15, 90.16, 123/90.27, 90.39, 90.41, 90.43, 90.44, 90.46, 198 F

[56] References Cited

U.S. PATENT DOCUMENTS

| | | | |
|---|---|---|---|
| 4,546,734 | 10/1985 | Kodama | 123/90.16 |
| 4,615,307 | 10/1986 | Kodama et al. | 123/90.16 |
| 5,357,916 | 10/1994 | Matterazzo | 123/90.16 |
| 5,501,186 | 3/1996 | Hara et al. | 123/90.16 |

FOREIGN PATENT DOCUMENTS

| | | |
|---|---|---|
| WO91/124115 | 8/1991 | European Pat. Off. . |
| 4000531 | 6/1990 | Germany . |
| 9319435.8 | 3/1994 | Germany . |

*Primary Examiner*—Weilun Lo
*Attorney, Agent, or Firm*—Henry M. Feiereisen

[57] ABSTRACT

A support element (1) is designed to be disconnected by a lift movement of a control cam, and includes radially movable coupling elements (12). To disconnect the support element (1), the coupling elements (12) are moved inwards by hydraulic medium, while at the same time a piston (4) communicating with the finger lever is held in cam-distant position by the hydraulic medium.

19 Claims, 4 Drawing Sheets

SWITCHABLE SUPPORT ELEMENT

BACKGROUND OF THE INVENTION

The invention relates to a switchable support element for a cam-actuated finger lever of a valve drive for an internal combustion engine, having a hollow cylindrical housing disposed with its outer jacket in a receiving bore of a cylinder head, with a piston disposed therein which is axially movable at least relative to the housing and supported by a compression spring.

Such a device is known from DE-A 40 00 531, and includes also a hollow cylindrical housing connected together with a hollow cylindrical inner element and disposed inside a cylinder head of an internal combustion engine. Both elements are biased by a compression spring in direction of discharge. The housing is provided with an oil supply line for enabling in conjunction with a control edge of the inner element and in dependence on an oil charge in the inner space enclosed by the two elements a lifting/lowering of the inner element relative to the housing and to thereby shut down or vary the stroke of the gas exchange valve which communicates with the support element via the finger lever. The different oil charge is effected by turning the housing relative to the inner element, since thereby different inlet flow cross sections are provided via the control edge.

The valve drive tappet known from above-stated DE-A 40 00 531 has the drawback that the oil cushion does not allow a formfitting, i.e. a defined cutoff/decrease of the valve lift. This oil cushion exhibits, on the one hand, a certain minimum compressibility, and on the other hand, oil losses can be expected across the sliding surface of both elements. Furthermore, it is anyhow difficult to achieve a precise stroke adjustment and fixation in this position by means of oil pressure, since the adjusted height is maintained directly through the oil pressure, and too many additional parameters which are hard to manage have an impact. In addition, the housing must be acted upon by mechanical forces to effect a rotation so that again a drive is needed. Other operational condition may also be conceivable, by which the gas exchange valve can be activated when the internal combustion engine is shutdown, i.e. the valve should not be turned off. The above solution makes no provisions therefor, since the aforementioned adjustment device collapses when the internal combustion engine is shutdown, thereby deactivating the respective gas exchange valve.

There are other switchable support elements known in the art (DE-GM 93 19 435.8), which effect a locking of the components for coupling the support element to the stroke motion of the control cam via radially displaceable pistons. In the decoupled state, a respective housing part executes an idle stroke during lifting of the control cam.

SUMMARY OF THE INVENTION

It is the object of the invention to improve a switchable support element in such a way that it exhibits a high stiffness when its components are locked, while in the disengaged state previously encountered friction losses are minimized and, at the same time, the support element can be disengaged at high rotational speeds.

This object is attained according to the invention by disposing in the piston at least one bore extending radially or as a secant and aligned with a respective other bore during the base circle portion of the cams, with at least one coupling element being arranged in one of the bores and moveable in the direction of the respective other bore for selectively coupling/decoupling of the support element with the finger lever secured thereto from a stroke motion of the control cam; by providing in a cam-distal bore of the piston an inner element which is axially moveable with respect to the other bore, wherein a cam-proximal end face of the inner element is spaced at a distance during the base circle portion of the control cam and in coupled state of the support element relative to a base of the bore, at formation of a piston space, which distance corresponds to the desired cutoff stroke of the finger lever; by positioning the piston to rest with its base in the decoupled state of the support element against the end face of the inner element, with the coupling element being completely displaced in one of the bores; and by arranging between a cam-proximate end face of the piston and a corresponding end face of the housing an upper annular space which can be filled with hydraulic medium for effecting a decoupling in opposition to the force of the compression spring, with the annular space having a height which at least corresponds to the desired cutoff stroke of the finger lever. It is not necessarily required, but desirable, that in a decoupled state, the base of the piston rests upon the end face of the inner element; it is, however, of importance to effect a complete disengagement of the inner element from the cam region.

The afore-stated measures effect, on the one hand, a locking through formfitting engagement, with the entire support element exhibiting a high stiffness. This high stiffness is particularly advantageous for the entire valve drive dynamics at high rotational speeds. At the same time, it is possible by using simple means, eliminating additional radially displaceable coupling elements, to completely disengage the support element with the finger lever secured thereto from the lifting motion of the control cam. The complete decoupling effects a decrease of the friction losses encountered in conventional devices as a result of continuous contact between the finger lever and the cam. At the same time, the force provided by a compression spring disposed in the support element and acting upon the finger lever in the event of feedback via the support element, can be reduced significantly. This decrease of the spring force effects a cutoff of the respective gas exchange valves even at the highest rotational speeds, since otherwise the aforementioned compression spring would have to be sized to be very strong for these rotational speeds. It is provided that the support element is in its coupled state when the hydraulic medium is not active, thereby guaranteeing operability under emergency conditions. While it is possible and also provided to couple via hydraulic medium and to decouple via the force of corresponding springs, the force of the compression spring may equally be replaced entirely by hydraulic medium. Instead of employing the compression spring and the hydraulic medium, respectively, the components may also be locked by magnetic, electromagnetic or other mechanical means which are not described in more detail.

Preferably, two diametrically opposed hydraulic pistons are employed which are acted upon by hydraulic medium radially from the outside through corresponding supply bores. This configuration according to the invention guarantees that no additional or only a minimum of additional installation space has to be provided for the support elements.

Movement of the hydraulic piston in a radially inward direction is limited by a stop element located in the center of the bore.

The air mass enclosed in the piston space in cooperation with the channel extending into the lower annular space provides a "soft" impact for the base of the extension upon the end face of the inner element, since the channel is so dimensioned that the air mass entrapped in the piston space acts as an air cushion. However, several such channels distributed around the circumference may also be envisioned. Instead of the channel on the end face and the bottom, respectively, corresponding damping elements, for example elements made of plastic material, may also be employed.

In accordance with the invention, the provided "hydraulic" retention of the piston of the support element in the decoupled position makes additional mechanical coupling elements unnecessary. The implementation of the invention is not adversely affected by the possibility of the oil mass flowing into the upper annular space and possibly mixing with the air mass contained therein.

It is especially advantageous to provide the support element according to the invention simultaneously with a conventional hydraulic clearance compensation element. It is, however, also possible to omit the hydraulic clearance compensation element and to resort to other known mechanical clearance compensation elements.

According to another feature of the present invention, a needle is so received in a radial recess of the main piston as to project beyond the recess on both sides for cooperation with corresponding longitudinal grooves formed outside on the inner element and the housing. The needle is mainly intended to ensure that the piston, the housing and the inner element do not rotate with respect to each other. The outer jacket of the housing is typically fixedly installed in the receiving bore. An upper end face of the longitudinal groove in the inner element, in conjunction with the needle, forms an additional stop/transport safety mechanism for the inner element.

A simple seal of the upper annular space is effected via an axial flange of the housing at the cam end, with the piston being formed with a hollow cylindrical extension axially projecting beyond the flange. Advantageously, at least the housing is made of thin sheet steel of deep-drawing quality; however, at least one of the components of the support element may also be made from plastic material or lightweight material.

The support element or its piston is preferably connected to the finger lever through a clamp connection; however, other connection means, such as screws or the like, may also be used.

In accordance with the invention, the distance between the cam-proximal end face of the inner element and the base of the bore is so selected as to effect a complete shutdown of the finger lever via the support element. If partial lifts are desired, the respective distance may conceivably be minimized. It may however also be possible to realize stepped lifts, effecting for example a rotation of the inner element with respect to the piston, and creating respective stops for the stroke via the needle of the piston.

The invention is not limited to the features set forth in the claims. Contemplated and provided are also combinations of individual claim features and combinations of individual claim features with the listed advantages and the features of the embodiment.

BRIEF DESCRIPTION OF THE DRAWING

The invention is now described with reference to the drawing, in which.

DETAILED DESCRIPTION OF PREFERRED EMBODIMENTS

In the following, the basic features of the switchable support element will be described with reference to FIGS. 1*a* and *b*, with a description of the FIGS. 2*a*, *b* and 3*a*, *b* restricted to explaining the different coupling states.

Figure 1B:
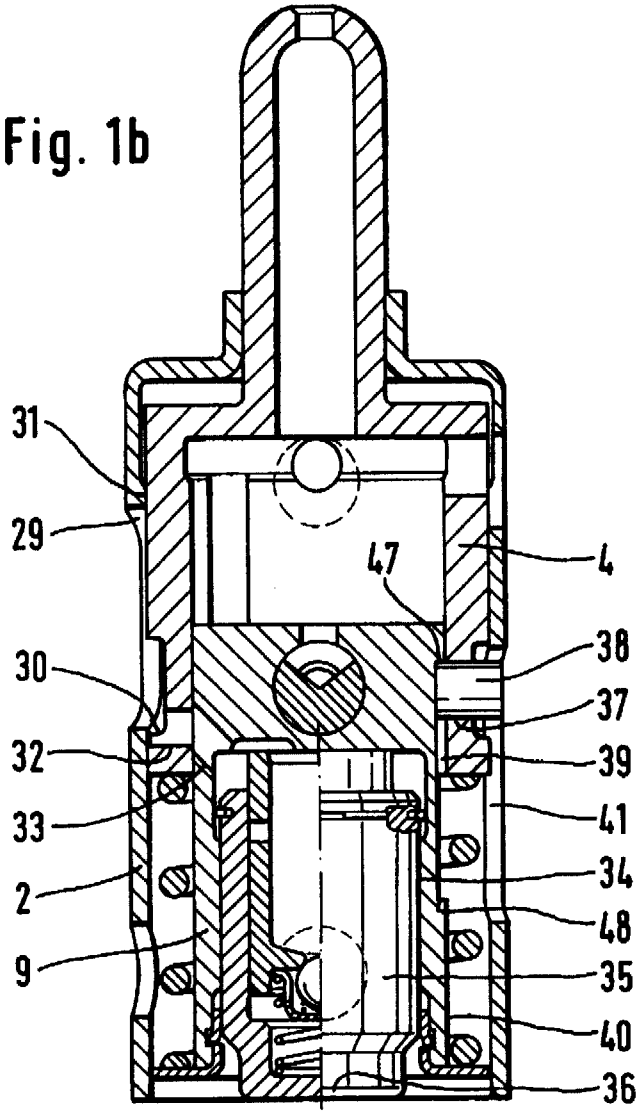
FIGS. 1 to 3 illustrate the various decoupling stages in two rotated views a and b of the support element according to the invention and FIG. 4 shows a general sectional overview of a cylinder head construction, incorporating a support element according to the invention.
Figure 1A:
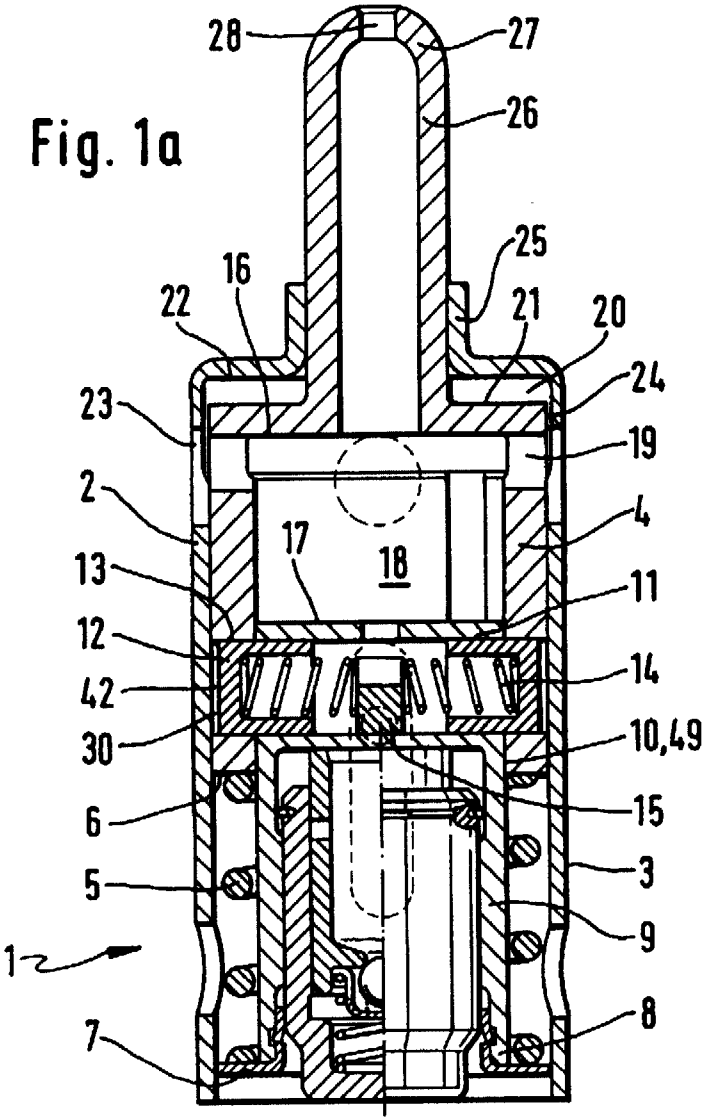
Figure 4:
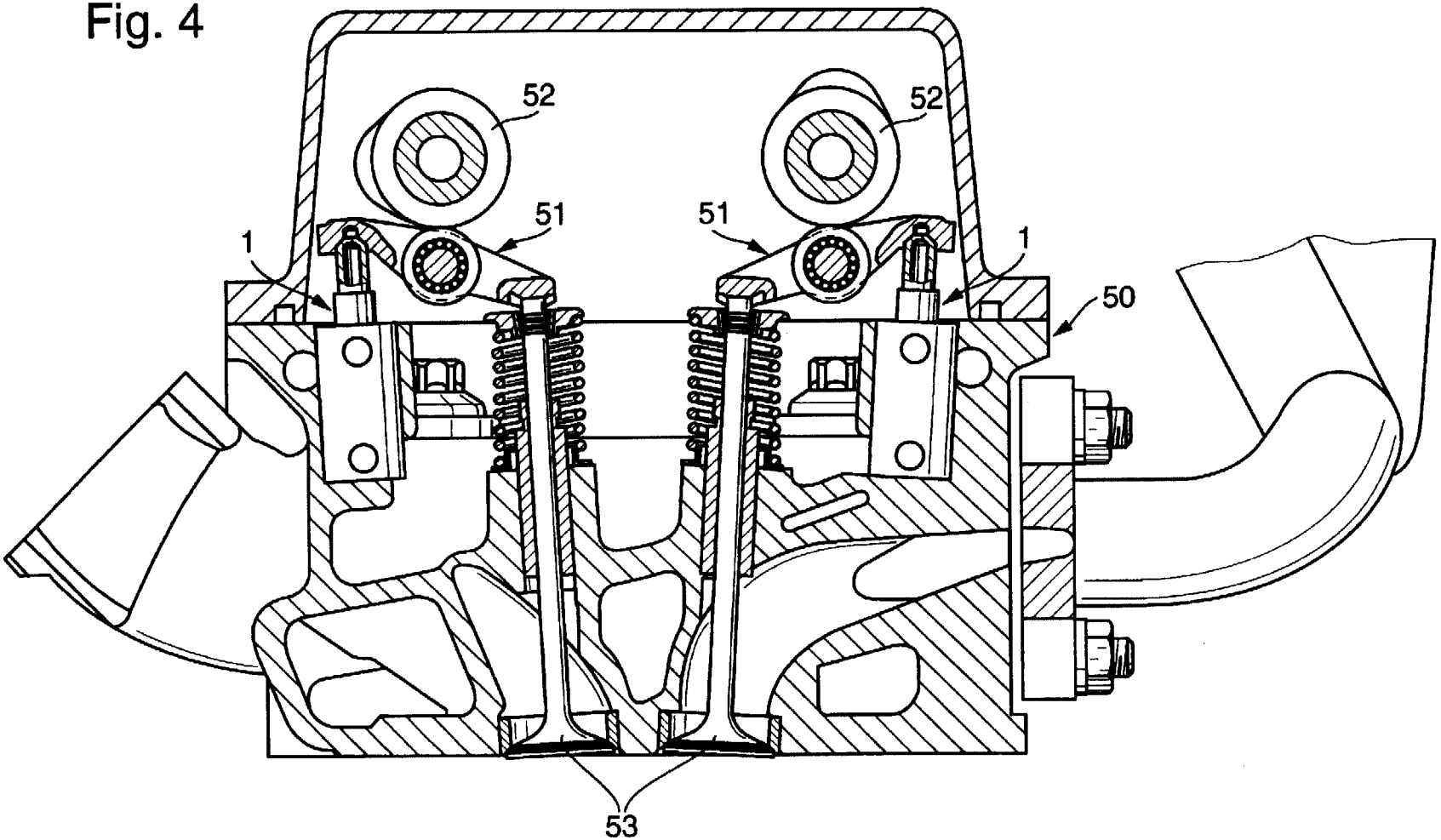

FIG. 1*a* shows a switchable support element 1 which includes a hollow cylindrical housing 2 disposed with its outside jacket 3 in a receiving bore of a stationary cylinder head generally denoted by reference numeral 50, as shown in FIG. 4. The support element 1 supports one end of a finger lever, generally denoted by reference numeral 51 which is in driving relationship between a control cam 52 and a gas exchange valve 53. Interaction between the cam 52, finger lever 51, and valve 53 is generally known so that a detailed description thereof is omitted for the sake of simplicity. Disposed inside the support element 1 is a piston 4 adapted for axial movement with respect to the housing 2. The piston 4 is biased by a compression spring 5 in cam direction. The compression spring 5 thus acts, on the one hand, upon a cam-distal end face 6 of the piston 4 and, on the other hand, upon a ring element 7. The ring element 7 is in turn connected to one end 8 of an inner element 9. The inner element 9 extends in a cam-distal bore 10 of piston 4 and adapted for axial movement therewith.

The inner element 9 includes a bore 11 extending radially. Positioned in the bore 11 on both ends are coupling elements 12 formed as hydraulic pistons. When the support element 1 is coupled, the coupling elements 12 extend simultaneously radially outwards into correspondingly aligned bores 13 of the piston 4. At the same time, the coupling elements 12 are each spring-biased radially outwards by the force of a respective compression spring 14. Radially inward travel of the coupling elements 12 is limited by a stop element 15 near the center of the bore 11 of inner element 9.

A base 16 of the bore 10 of the piston 4 is separated from an end face 17 of the inner element 9 by a distance corresponding to the desired cutoff stroke of the support element 1. Formed between the two faces 16, 17 is a piston space 18. The piston space 18 is provided with radial bores 19 arranged around its circumference near the base 16 for allowing air residing in the piston is space 18 to flow into an upper annular space 20, with the annular space 20 extending between a cam-proximal end face 21 of the piston 4 and a corresponding end face 22 of the housing 2. At the same time, the housing 2 is provided with bores 23 in alignment with the bores 19. These bores 23 allow a conduction of a first partial amount of air from the piston space 18 into the annular space 20 in a manner to be described later. A ground undercut 24 disposed in the region of the annular space 20 may simultaneously be used to conduct air from the piston space 18 into the annular space 20.

The end face 22 of the housing 2 terminates radially inwardly in cam direction in an axial flange 25. At the same time, the piston 4 is guided with a hollow cylindrical extension 26 in the axial flange 25 and juts outwardly in axial direction beyond the axial flange 25. In this embodiment, a cam-proximal end face 27 of the extension 26 is provided with a bore 28 by which a calotte of a finger lever 51 supported by the support element 1 can be lubricated.

As illustrated in FIG. 1*b*, the housing 2 includes an elongated recess 29. This recess 29 communicates in the coupling position depicted here with a ring groove 30 in the outer jacket 31 of the piston 4. The ring groove 30 simultaneously communicates with a passageway 32, 33 through the piston 4 and the inner element 9 for supplying hydraulic medium to a hydraulic clearance compensation element 35 disposed in a bore 34 of the inner element 9. The end 36 of the clearance compensation element 35 faces directly a base of the receiving bore of the cylinder head 50.

At the same time, a needle 38 is disposed in a recess 37 of the piston 4 and projects outwardly past the piston surface on both sides for preventing a rotation of the components 2, 4, 9 with respect to each other. The needle 38 cooperates, on the one hand, with a longitudinal groove 39 at the outer jacket 40 of the inner element 9 and engages, on the other hand, in a further longitudinal groove 41 of the housing 2.

After having described the structure of the support element 1 according to the invention, the mode of operation will now be discussed in more detail.

In the FIGS. 1*a*, *b*, the support element 1 is depicted in its coupling position. In this state, there is only applied low pressure to the hydraulic medium at recess 29 for supply of the clearance compensation element 35. This hydraulic pressure is not sufficient to displace the coupling elements 12, which are acted upon their outer end face 42 by hydraulic medium via the ring groove 30, radially inwardly into the bore 11 against the spring force of compression springs 14 to such an extent that they completely remain inside the bore 11 and do not project with their end face 42 beyond the outer jacket 40 of the inner element 9.

Figure 2B:
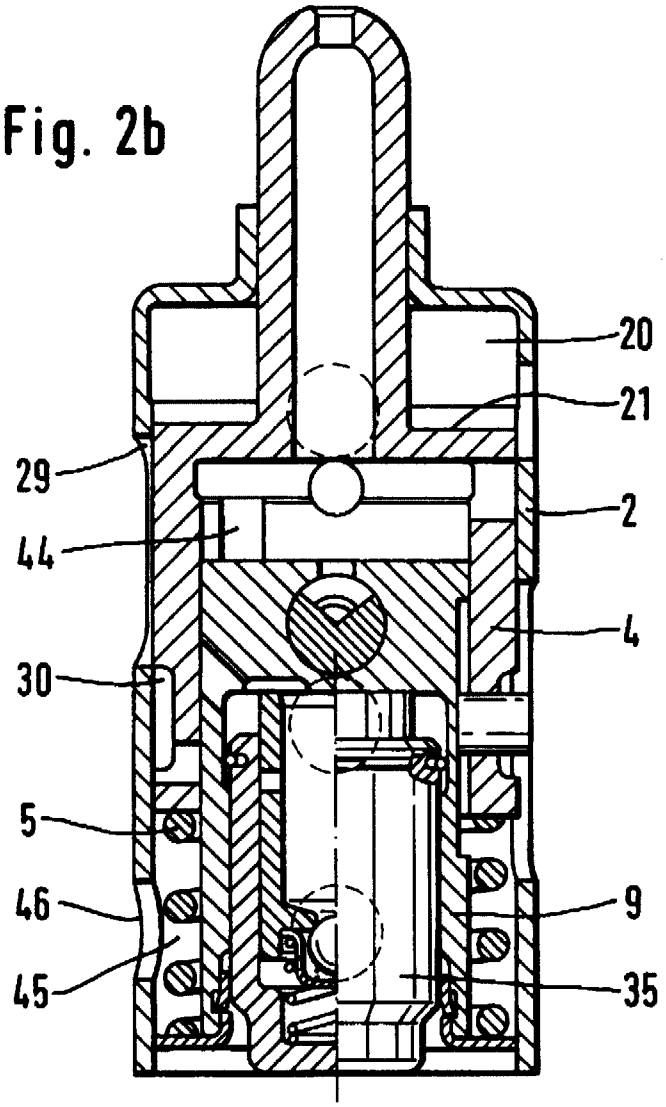
Figure 2A:
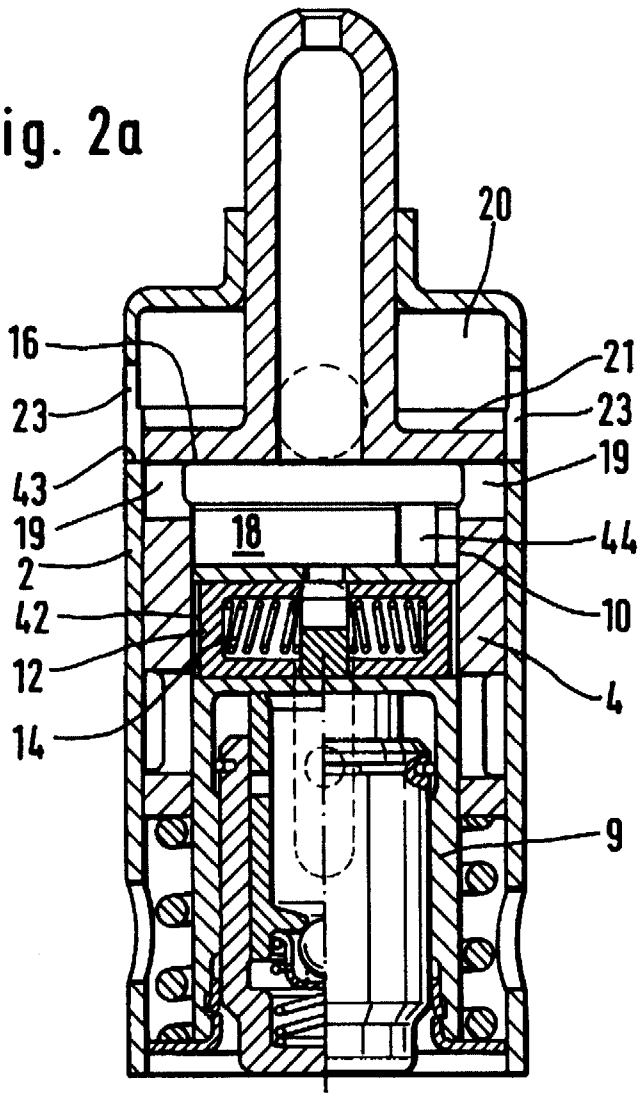
Figure 3B:
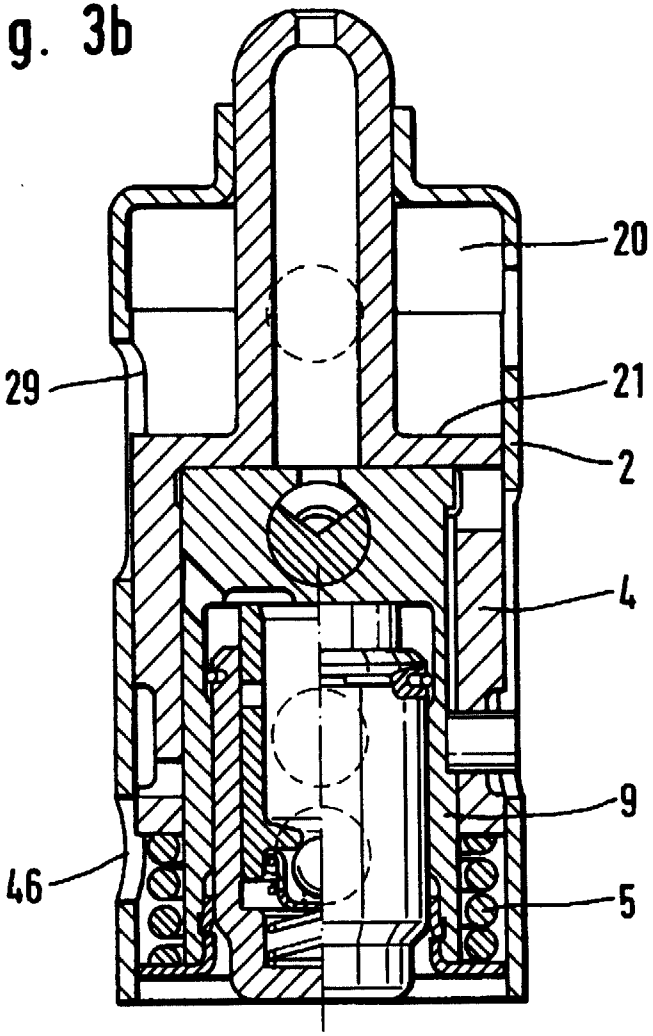
Figure 3A:
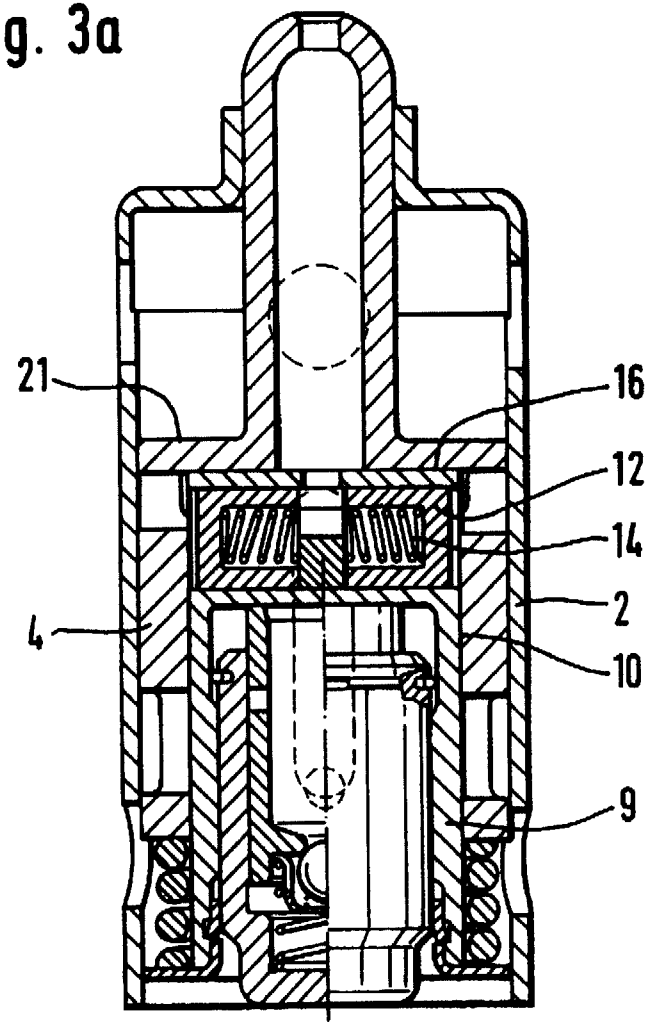

When the pressure of the hydraulic medium to the ring groove 30 is increased at the recess 29, then the coupling elements 12 shift during in the base circle portion of the control cam 52 completely into their bore 11 against the spring force of their respective compression springs 14. The piston 4 is moved away from the cam at commencement of the cam lift, with air residing in the piston space 18 being conducted into the upper annular space 20 via bores 19, 23. The bore 23 in the housing 2 aiding the overflow forms a control edge 43 in the area most distant from the cam 52 (see FIG. 2). The bore 23 with its control edge 43 are thereby positioned in such a way that the piston 4 entraps a residual amount of air in the piston space 18 extending to the base 16 when it passes the control edge 43 on its axially downward motion. Since at this point air can no longer flow from space 18 into space 20, a further escape of the residual amount of air in the piston space 18 is effected through a channel 44 extending in the bore 10 of the piston 4 axially away from the cam 52. The channel 44 terminates with its cam-distal end in a lower annular space 45 between the inner element 9 and the housing 2 for receiving the compression spring 5. The air pushed out of the piston space 18 can escape therefrom through discharge openings 46 distributed around the circumference of the housing 2 into not shown exhaust lines of the cylinder head 50. The cross section of channel 44, including the possibility of having several channels per support element 1, is so dimensioned that air can only escape from the space 18 while performing compressive work. This provides for a "soft" seating of the piston 4 (see FIGS. 3*a* and *b*) with the base 16 of its bore 10 on the cam-proximal end face 17 of the inner element 9. As can be seen from FIGS. 2 and 3, the piston 4 releases during its continuing axial downward motion a partial cross section of the recess 29 which is subject to hydraulic pressure. The hydraulic medium flowing into the annular space 20 through the recess 29 retains the piston 4 in the final position shown in the FIGS. 3*a*, *b* as a result of the pressure exerted on the cam-proximal end face 21 of the piston 4.

Should a feedback from the respective support element 1, including the finger lever 51, to the stroke motion of the respective gas exchange valve be desired, then the pressure of hydraulic medium at the recess 29 is reduced. As a result, the piston 4 can now be moved by the spring force of the compression spring 5 in cam direction. When the upper final position depicted in the FIGS. 1*a*, *b* is reached (base circle portion of the control cam 52), the coupling elements 12 are partially displaced radially outwardly into the bore 13 of the piston 4 by the spring force of their compression spring 14. Air or air-oil mixture remaining in the annular space 20 can reach the piston space 18 through the bores 23, 19 or can escape through the channel 44.

As a result of the support of the compression spring 5 on the inner element 9 and the piston 4, there is provided a inner closed force flux of the compression spring 5 in the locked state. Consequently, a possible influence of the compression spring 5 on the operation of the clearance compensation element is eliminated.

The shown disengagement of a gas exchange valve by way of a switchable support element 1 is suitable for selective cutoff of individual gas exchange valves in multi-valve technology, in an entire cylinder shutdown or even in a shutdown of entire cylinder banks, for example for V-engines.

What is claimed is:

1. A switchable support element for a cam-actuated finger lever of a valve drive for an internal combustion engine, comprising:

a hollow cylindrical housing disposed in a receiving bore of a cylinder head;

a spring-biased main piston disposed in the housing and axially movable relative to the housing, said main piston defining an axial first bore and being formed with at least a second bore;

an inner element so received in the axial bore of the main piston as to allow a relative displacement between the main piston and the inner element in response to an operation of a control cam, said inner element being formed with a bore which is in alignment with the second bore of the main piston during a base circle portion of the control cam; and a coupling element so positioned in at least one of the second bore of the main piston and the bore of the inner element as to be displaceable in a direction toward the other one of these bores for movement between a coupled state in which the coupling element couples the main piston and the inner element and a decoupled state in which the coupling element is received in only one of these bores and the main piston is disengaged from the inner element;

said inner element having a cam-proximal end face which is spaced from an opposing end face of the main piston during the base circle portion of the control cam and in the coupled state to define a piston space having a vertical extension corresponding to the desired cutoff stroke of the finger lever, and with an annular upper space being formed between a cam-proximate end face of the main piston and an opposite end face of the housing and so connected as to be permit entry of hydraulic medium to act upon the main piston in the decoupled state, with the upper annular being defined by a minimum vertical extension which at least corresponds to the extent of a desired cutoff stroke of the finger lever.

2. The support element of claim 1 wherein the second bore of the main piston extends in a radial direction.

3. The support element of claim 2 wherein the second bore of the main piston extends along a secant.

4. The support element of claim 2 wherein the piston space is in fluid communication with the upper annular space.

5. The support element of claim 1 wherein the end face of the main piston rests in the decoupled state against the cam-proximal end face of the inner element.

6. The support element of claim 5 wherein the coupling element includes a hydraulic piston extending in the bore of the inner element, and at least one compression spring loading the hydraulic piston in radially outward direction, with the hydraulic piston bridging in the coupled state an annular interface between the main piston and the inner element and thereby partially extending in the second bore of the main piston, and in decoupled state being so acted upon at its radially outer end face by hydraulic medium as to shift completely into the bore of the inner element.

7. The support element of claim 5 wherein the main piston is formed with a ring groove in immediate proximity of the end face of the hydraulic piston and in communication with a complementary recess in the housing for supply of hydraulic medium.

8. The support element of claim 1 wherein the coupling element includes a central stop member secured in the bore of the inner element for limiting a displacement of the hydraulic piston.

9. The support element of claim 3 wherein the main piston is provided in the area of the piston space with at least one other bore for permitting a first partial volume of air to escape from the piston space into the upper annular space when the main piston is moved axially downwards, said housing being formed with a bore in communication with the other bore of the main piston during a first stroke phase thereof, wherein the piston space is connected to a lower annular space radially disposed between the housing and the inner element underneath the piston space by an axially extending channel for discharging in a second stroke phase of the main piston a remaining volume of air from the piston space into the lower annular space while performing compressive work, with at least one discharge opening being provided in a cam-distant section of the housing for exit of air from the lower annular space.

10. The support element of claim 1 wherein the main piston is biased by a compression spring received in the lower annular space and extending between a cam-distal end face of the main piston and a ring element secured to one axial end of the inner element.

11. The support element of claim 1 wherein the housing is formed with an outer recess in communication with the upper annular space for passage of hydraulic medium at least during the second stroke phase.

12. The support element of claim 11, and further comprising a hydraulic clearance compensation element received in a cam-distal bore of the inner element and having an axial end directly facing a base of the receiving bore of the cylinder head.

13. (New) The support element of claim 7, and further comprising a hydraulic clearance compensation element received in a cam-distal bore of the inner element and having an axial end directly facing a base of the receiving bore of the cylinder head, said clearance compensation element being supplied with hydraulic medium via a passageway defined by the recess in the housing, the ring groove in the piston and a passage formed in the main piston and the inner element and communicating with the ring groove.

14. The support element of claim 1, and further comprising a needle so received in a radial recess of the main piston as to project beyond the recess on both sides for cooperation with corresponding longitudinal grooves formed outside on the inner element and the housing.

15. The support element of claim 1 wherein the end face of the housing terminates in a cam direction radially inwardly in an axial flange, said main piston being formed with a hollow cylindrical extension so protruding axially beyond the axial flange as to have sections encircled by the axial flange.

16. The support element of claim 15 wherein the cylindrical extension has a cam-proximate end face provided with a bore.

17. The support element of claim 1 wherein at least the housing is made of thin sheet steel.

18. The support element of claim 1 wherein at least the housing is made by a deep-drawing process.

19. The support element of claim 1 wherein the cam-proximate end face of the inner element is so spaced from the opposite end face of the main piston as to realize a complete cutoff of the finger lever via the support element.

* * * * *